US005575031A

United States Patent [19]

Chai

[11] Patent Number: 5,575,031

[45] Date of Patent: Nov. 19, 1996

[54] PILLY REMOVER

[76] Inventor: David C. H. Chai, No.15, Shan Hsi 4th Street, North District, Taichung, Taiwan

[21] Appl. No.: 518,595

[22] Filed: Aug. 11, 1995

[51] Int. Cl.[6] ..... A47L 25/08

[52] U.S. Cl. ..... 15/111; 15/104.001; 15/105; 15/236.06; 30/136

[58] Field of Search ..... 15/104.001, 104.002, 15/105, 104.8, 236.06; 30/124, 304, 136; 119/85, 86, 87, 90; 606/133

[56] References Cited

U.S. PATENT DOCUMENTS

| | | | |
|---|---|---|---|
| 1,232,158 | 7/1917 | Youngs | 15/104.001 |
| 1,957,591 | 5/1934 | Heckert | 15/105 |
| 2,257,600 | 9/1941 | Fuchs | 15/104.001 |
| 2,934,810 | 5/1960 | Kanbar | 15/104.001 |
| 4,686,731 | 8/1987 | Suzuki | 15/104.001 |
| 4,687,095 | 8/1987 | Iwasaki | 15/104.002 |

FOREIGN PATENT DOCUMENTS

| | | | |
|---|---|---|---|
| 2204228 | 11/1988 | United Kingdom | 15/104.002 |

*Primary Examiner*—David Scherbel
*Assistant Examiner*—Randall E. Chin
*Attorney, Agent, or Firm*—Bacon & Thomas

[57] ABSTRACT

Pillies on the staple fibers of a fabric surface are removed by rubbing a plurality of arcuate blades over the surface of the fabric to guide the pillies into a plurality of double blade defining notches at the uppermost edges of holes formed in the blades.

5 Claims, 4 Drawing Sheets

PILLY REMOVER

BACKGROUND OF THE INVENTION

The present invention relates to a pilly remover, and particularly to a remover which does not use electricity or adhesive, and which easily and quickly removes pillies at their roots by softly rubbing the surface of a fabric with the remover.

Fabrics of wool, silk, nylon, etc. will produce pillies after wear or use and cause an appearance problem. The conventional way of removing pillies may include using an electric type remover that is similar to an electric shaver and an adhesive type remover. The electric type remover involves a very complicated mechanism that is expensive and requires a power supply. Since the electrically driven blades require that they be full circular blades to produce the cutting effect, they will cause damage to the yarns of woolen fabrics. As to the adhesive type remover shown in FIG. 1, it has an adhesive rubber wheel 1 for sticking pillies by rolling over the surface of woolen fabrics. However, it is unable to remove pillies effectively, especially for pillies with strong roots, and the adhesive effect will be reduced because of pilling, usage and dust sticking to the surface of the rubber wheel. Therefore, the conventional pilly removing devices are not effective and practical in use.

DETAILED DESCRIPTION OF THE PREFERRED EMBODIMENTS

Figure 1:
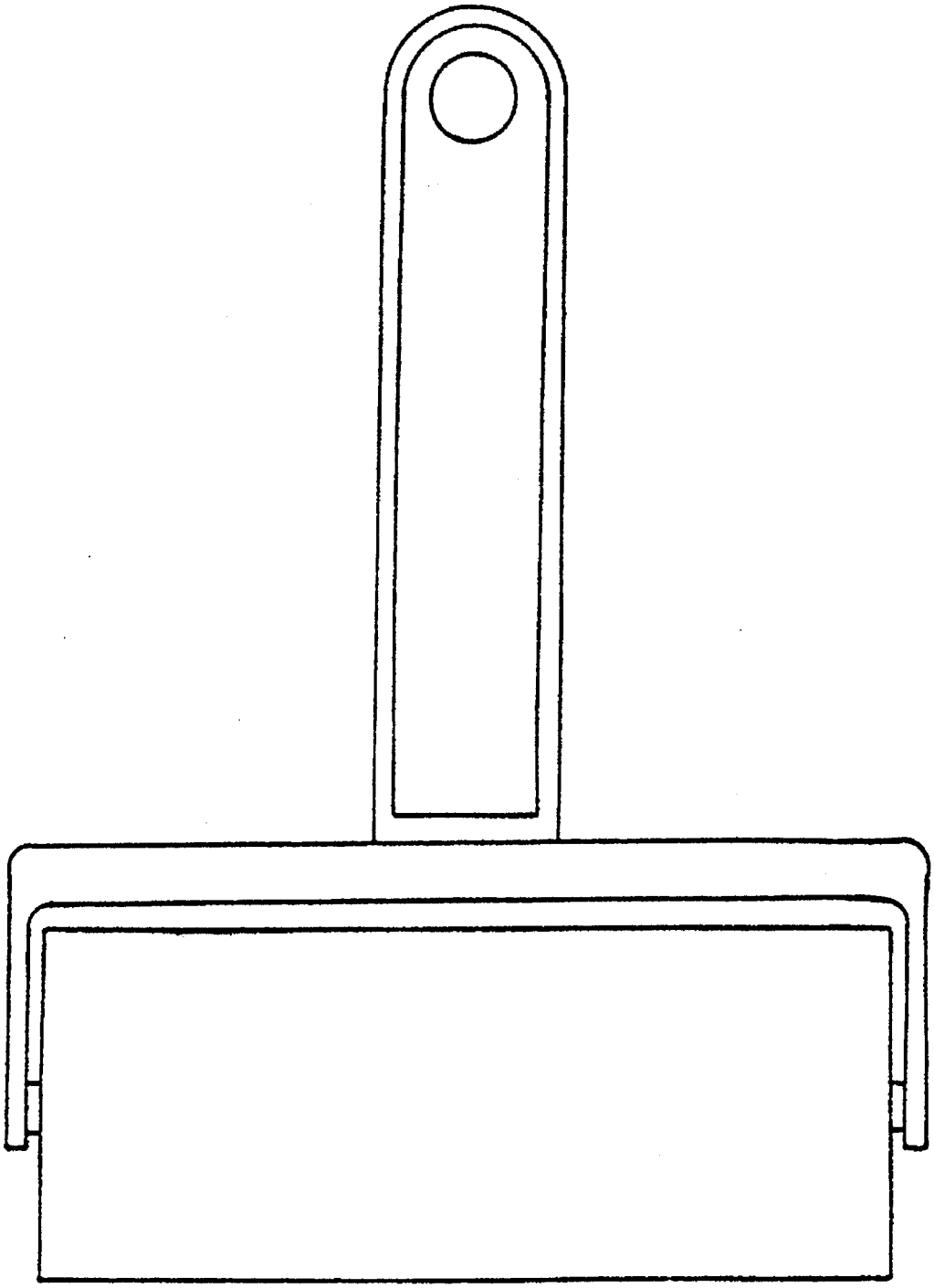
FIG.1 PRIOR ART
FIG. 1 is a diagrammatic view of the conventional adhesive type pilly remover.
Figures 2, 2A:
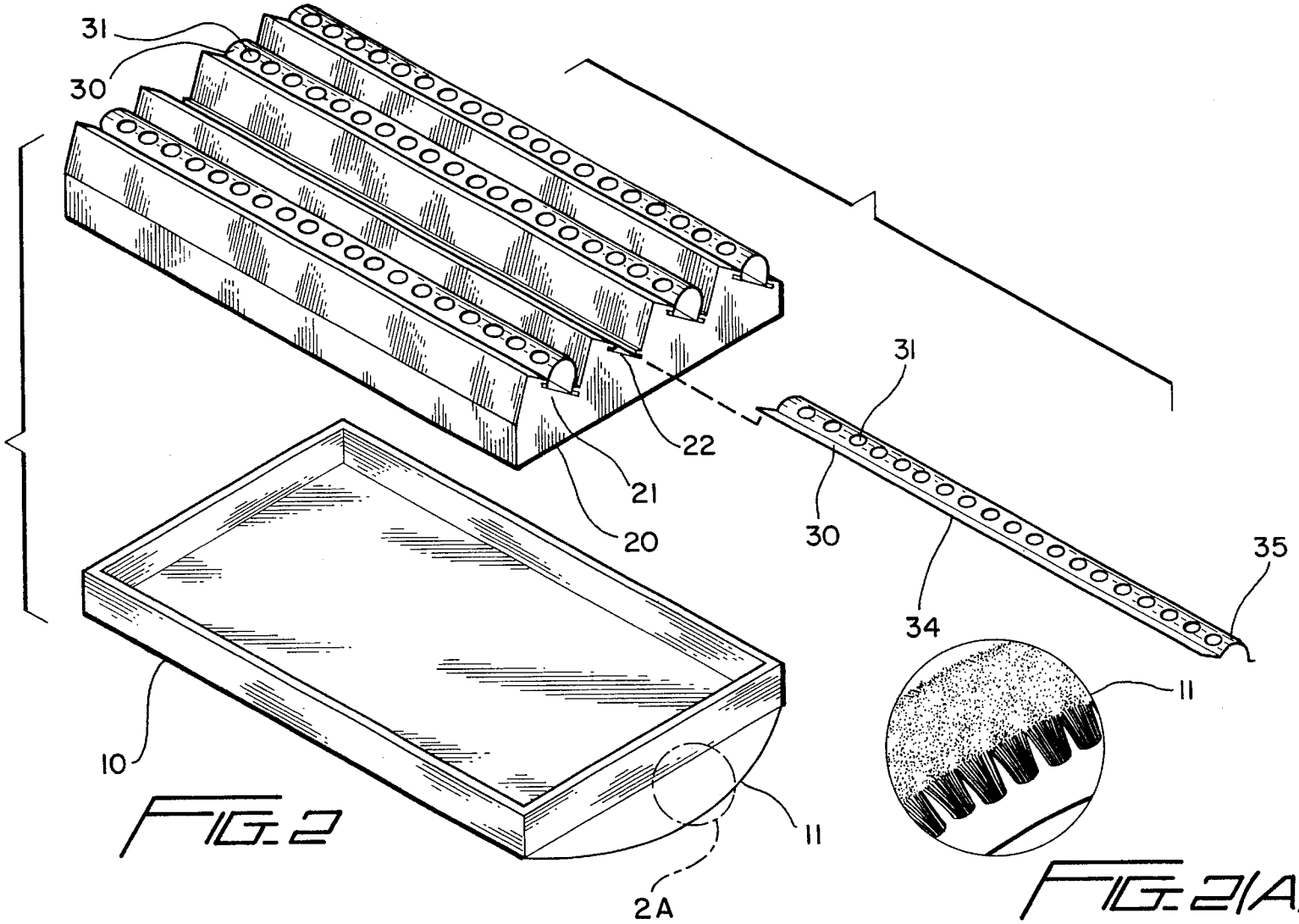
FIG. 2 is an exploded view of a pilly remover according to the present invention.
FIG. 2A is an enlarged view of the circled portion designated 2A in FIG. 2.
Figure 3:
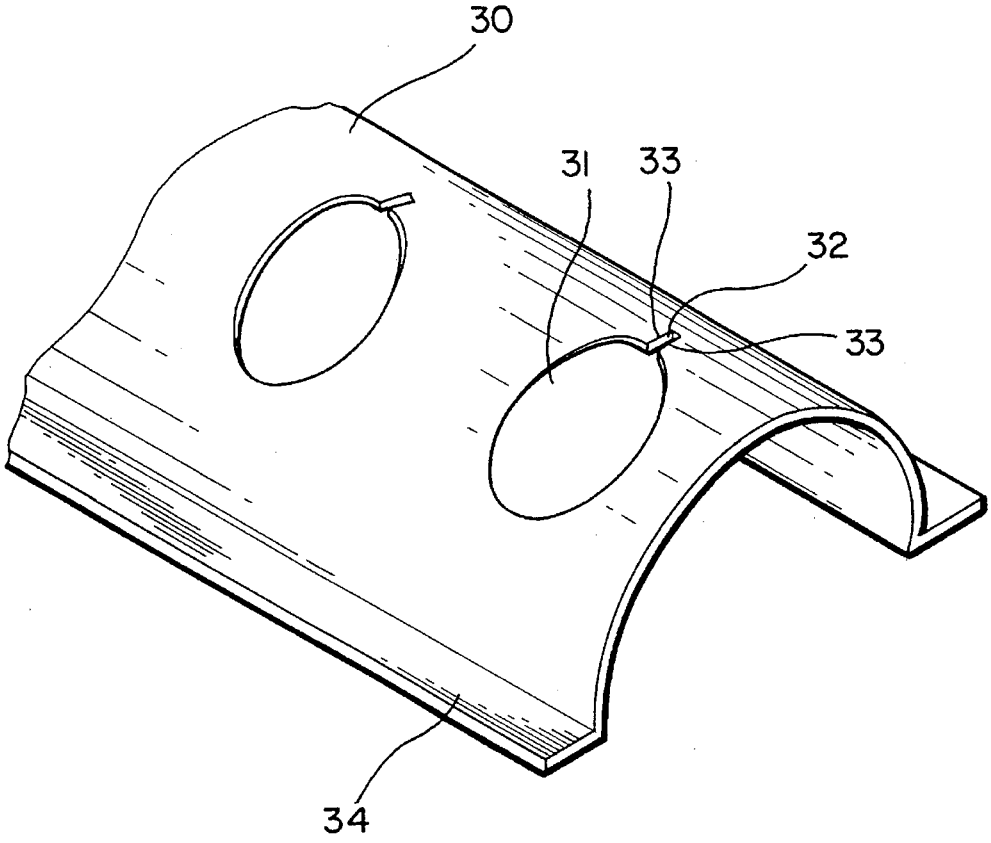
FIG. 3 is a perspective view of a blade of the present invention.

Referring to FIGS. 2 and 3, the present invention comprises a main body 10, a fixing seat 20 and a blade 30 wherein the main body 10 resembles a rectangular frame for receiving fixing seat 20 therein on one side and a brush 11 on the other side. The fixing seat 20 includes a plurality of bevel projection seats 21, with each projection seat 21 having a setting slot 22 thereon. The blade 30 has an arcuate configuration defining a collection chamber 35 and is formed from a thin and flexible spring steel plate. Each side of blade 30 has a setting edge 34 for assembling blade 30 to the setting slot 22 and integrally assembling blade 30 with fixing seat 20. Blade 30 has a plurality of holes 31, which may be of different sizes, with holes 31 being mixed and distributed depending on different sizes, row by row for a plurality of blades 30. The top end edge of each hole 31 is provided with a small notch 32 to form a double blade 33 configuration located at the uppermost top position of the arcuate blade 30.

Figure 4A:
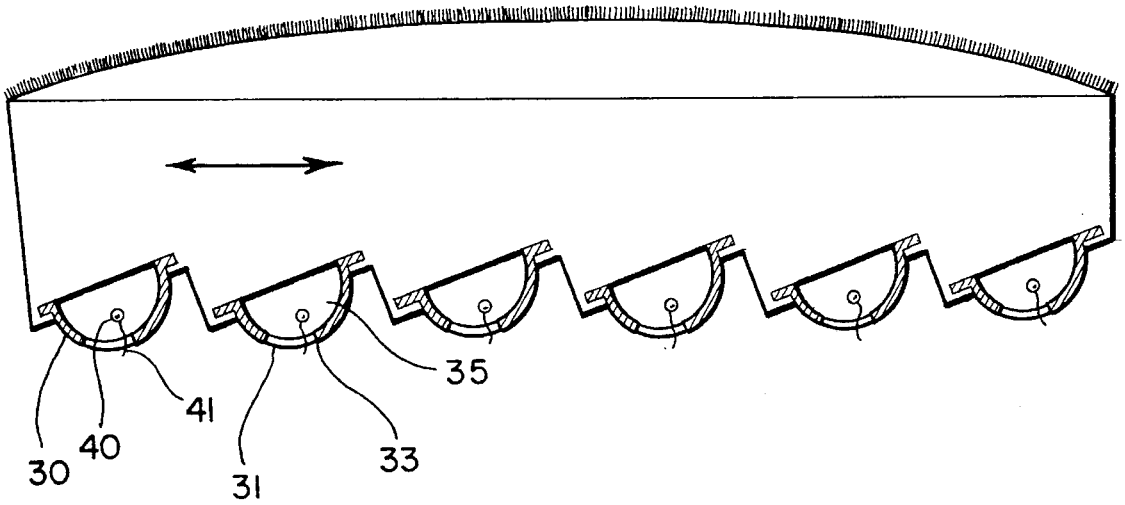
FIG. 4A is a cross-sectional view of the present invention.
Figure 4:
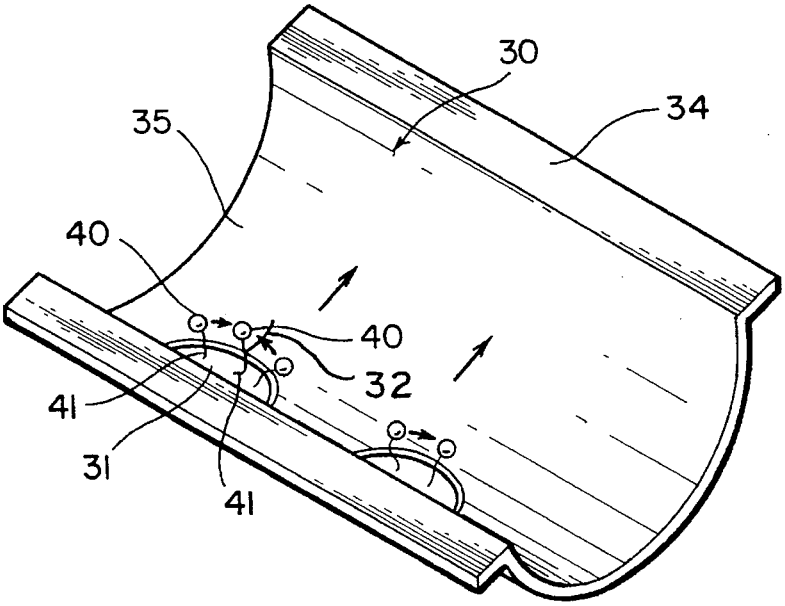
FIG. 4 is a perspective view of the blade showing the direction of cut.

The method and advantage of the present invention shall now be described with reference to FIGS. 4A and 4. Each blade 30 is applied to the surface of woolen, cloth, silk, flannel, nylon fabrics by rubbing blades 30 back and forth on the fabric in the directions of the double arrow in FIG. 4A. The root 41 of each pilly 40 on the surface of the fabric will be smoothly guided into a notch 32. Each notch 32 forms a fine point by the double blade 33 to provide a "point blade" effect. When each pilly 40 has entered a hole 31 and its root 41 has entered the double blade 33 from the notch 32, the pilly root 41 is cut by the double blade 33 to remove the pilly 40 from the fabric. Since the double blade 33 is very thin and sharp, force may be instantly and quickly applied to increase the pilly removing effect of the blade 33. Each cut pilly 40 is thus pushed forward, and a few of the cut pillies 40 which will be collected in the collection chamber 35 of blade 30 can be disposed of by shaking them out of the open ends of blade 30. Therefore, the present invention is easy and quick for removing pillies 40 from their roots without the disadvantages of the conventional electric shaving type and adhesive type removers.

What must be emphasized is that when a staple or fiber root has no pilly 40 or the pilly 40 has been removed therefrom and passed by the notch 32 and the double blade 33, no pilly 40 enters the hole 31 to produce a fixing of the staple fiber in hole 31. In such case, the staple just slides over the notch 32 and double blade 33 without experiencing a cutting effect. Therefore, there will be no cutting and damage to the staple fibers without pillies and use of the invention is harmless to such staple fibers of the original fabric material.

Upon the completion of pilly removal with the invention, any residual cut pillies 40 remaining on the surface of the fabric may be removed by the user with a brush 11 on the main body, as seen in FIGS. 2 and 2A. Each blade 30 is detachably secured to fixing seat 20 to facilitate replacement of each blade 30 in order to always maintain sharp blades 30 on seat 20.

Figure 5:
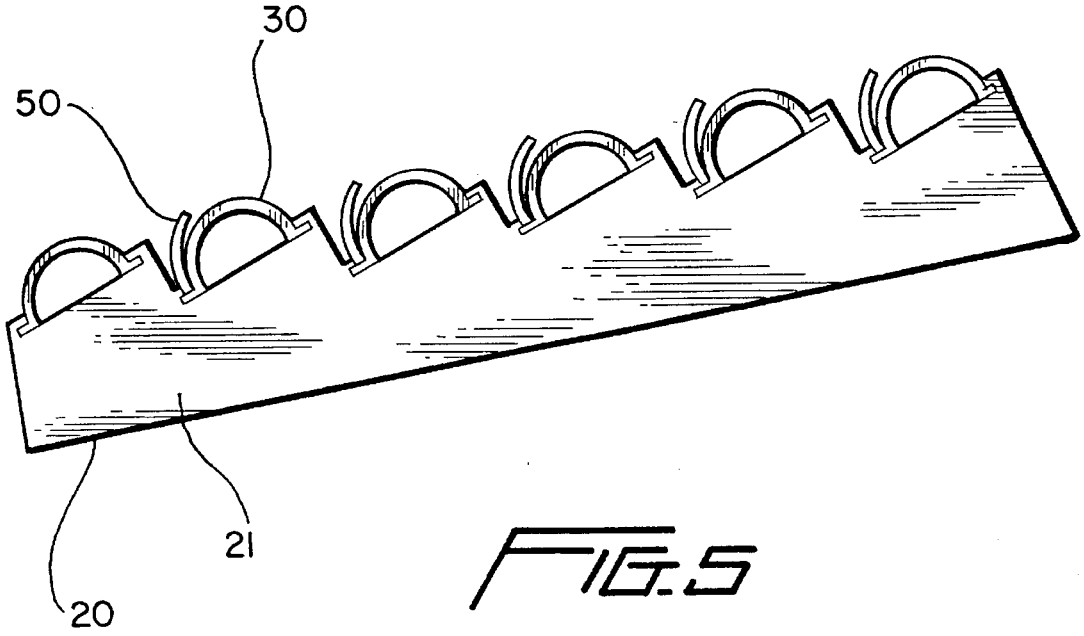
FIG. 5 is a cross-sectional view of the present invention with a plurality of scrapers.

The fixing seat 20 may be provided with a scraper 50, as shown in FIG. 5, in each projection seat 21, with scraper 50 extending as high as the blade 30. When the pillies 40 are being removed, said scrapers 50 may flatten the fabric and push the pillies 40 forward to facilitate their removal.

As described above, the present invention has several advantages.

It uses a non-shaving type remover for cutting pillies at their roots by means of double blades having a "point blade" effect which do not cut the staple yarns or fibers of the fabric. Each pilly is quickly and easily removed. Each blade of the remover is replaceable and the length of the blade may be varied for different applications. The remover is portable and does not require a power supply. Finally, the remover may be used with any type of fabric, particularly wool fabrics.

What is claimed is:

1. A pilly remover comprising:

a) a main body including a fixing seat thereon, the fixing seat having at least one projection seat defining a setting slot;

b) an arcuate blade including a pair of opposed setting edges, the blade being detachably secured to the projection seat through engagement of the setting edges with the setting slot;

c) a plurality of spaced holes formed in the blade, each hole including a top edge and a notch defining a double blade provided at the top edge; and d) wherein when the blade is rubbed across the surface of a fabric containing pillies supported on fiber roots, the pillies are disposed within the holes of the blade and directed to the notches wherein the double blades cut the roots of the pillies to remove the pillies from the fibers.

2. The pilly remover of claim 1 wherein the main body further includes a brush for removing the cut pillies from the fabric.

3. The pilly remover of claim 1 wherein the projection seat includes a scraper for smoothing the fabric and pushing the pillies forward to facilitate the cutting and removal of the pillies from the fabric.

4. The pilly remover of claim 1 further including a plurality of projection seats and a plurality of arcuate blades detachably secured within the setting slots of the projection seats.

5. The pilly remover of claim 4 wherein the spaced holes formed in the blades are of different sizes.

* * * * *